US012753534B2

(12) United States Patent
Del Sorbo et al.

(10) Patent No.: US 12,753,534 B2
(45) Date of Patent: Oct. 6, 2026

(54) METHOD FOR DETERMINING A WEAVING MAP

(71) Applicant: SAFRAN, Paris (FR)

(72) Inventors: Pietro Del Sorbo, Moissy Cramayel (FR); Anselme Clavier, Moissy Cramayel (FR); Guillaume Pichon, Moissy Cramayel (FR); Dominique Marie Christian Coupe, Moissy Cramayel (FR)

(73) Assignee: SAFRAN, Paris (FR)

( * ) Notice: Subject to any disclaimer, the term of this patent is extended or adjusted under 35 U.S.C. 154(b) by 0 days.

(21) Appl. No.: 19/134,054

(22) PCT Filed: Nov. 22, 2023

(86) PCT No.: PCT/FR2023/051839
§ 371 (c)(1),
(2) Date: May 29, 2025

(87) PCT Pub. No.: WO2024/115841
PCT Pub. Date: Jun. 6, 2024

(65) Prior Publication Data

US 2026/0193819 A1 Jul. 9, 2026

(30) Foreign Application Priority Data

Nov. 30, 2022 (FR) ..... 2212588

(51) Int. Cl.
*D03C 19/00* (2006.01)

(52) U.S. Cl.
CPC ..... *D03C 19/005* (2013.01); *D10B 2505/02* (2013.01); *D10B 2505/12* (2013.01)

(58) Field of Classification Search
CPC .... D03C 19/00; D03C 19/005; D03D 13/004; D03D 25/005; D10B 2505/02; D10B 2505/12
USPC ..... 700/131
See application file for complete search history.

(56) References Cited

U.S. PATENT DOCUMENTS 3,634,827 A * 1/1972 Lourie ..... D03C 19/005 700/131
11,408,099 B2 8/2022 Zhao et al.
2022/0119992 A1 4/2022 Zhao et al.

OTHER PUBLICATIONS

International Search Report as issued in International Patent Application No. PCT/FR2023/051839, dated Mar. 15, 2024.

(Continued)

*Primary Examiner* — Nathan E Durham
(74) *Attorney, Agent, or Firm* — CUSHMAN PARTNERS LLC

(57) ABSTRACT

A method for determining a weaving map of a zone of a part to be manufactured in a woven composite material, includes receiving a representation of the zone of the part; receiving predefined values of parameters relating to manufacturing constraints in the zone of the part; determining, from the representation and from a first subset of values from among the received predefined values, a weaving grid of the zone of the part, the weaving grid including a plurality of cells; and successively determining, for each cell of the weaving grid, a respective weaving composition compatible with a second subset of values from among the received predefined values.

13 Claims, 7 Drawing Sheets

(56) References Cited

OTHER PUBLICATIONS

Wielhorski, Y., et al., "Numerical modeling of 3D woven composite reinforcements: A review," Composites Part A, Elsevier, Amsterdam, NL, vol. 154, Dec. 2021, pp. 1-25, XP086928147.

* cited by examiner

[Fig. 1]
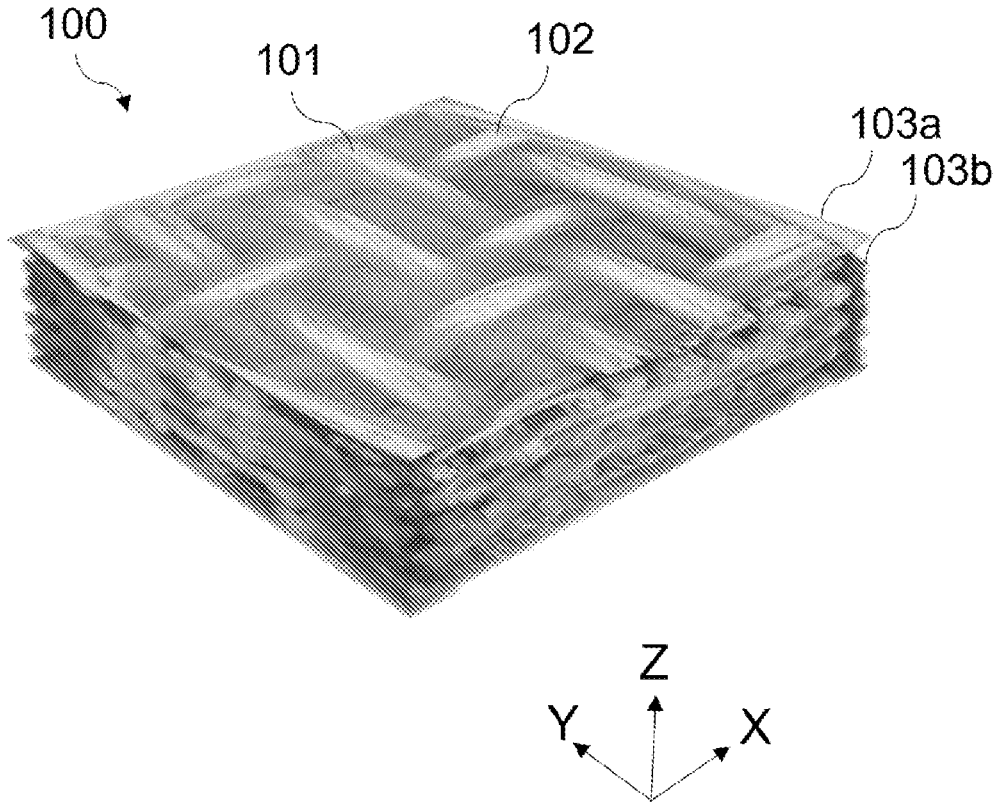

[Fig. 2]
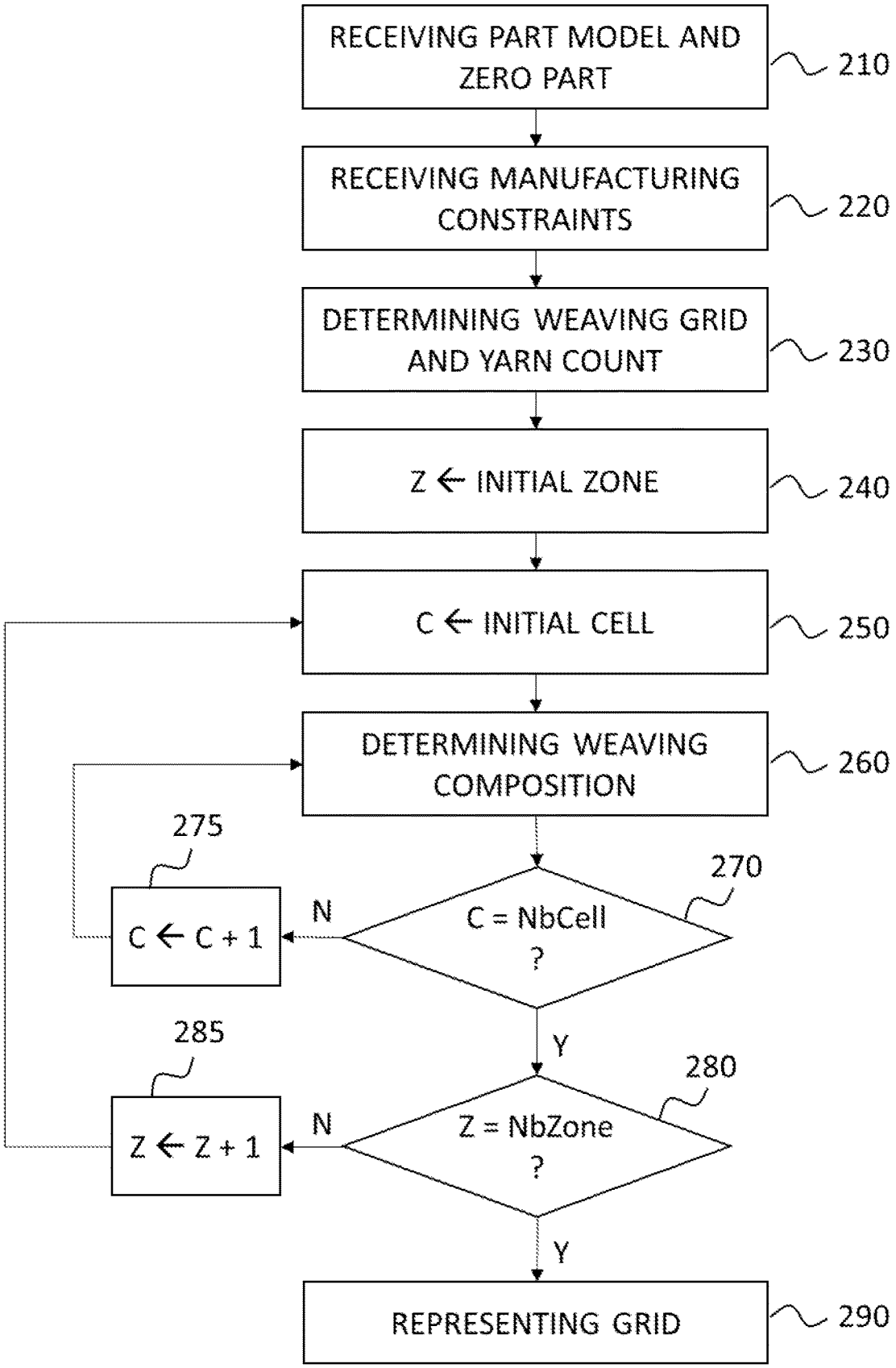

[Fig. 3a]
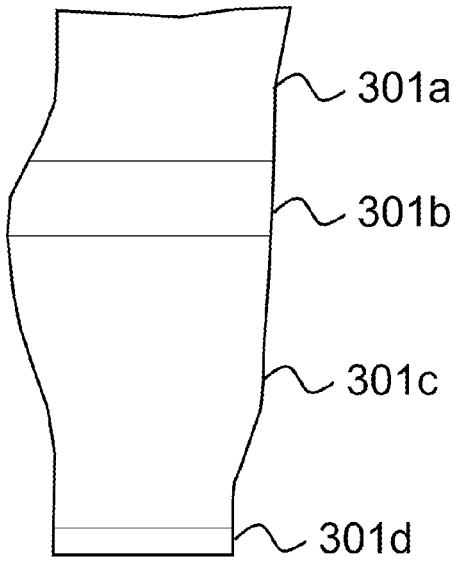
[Fig. 3b]
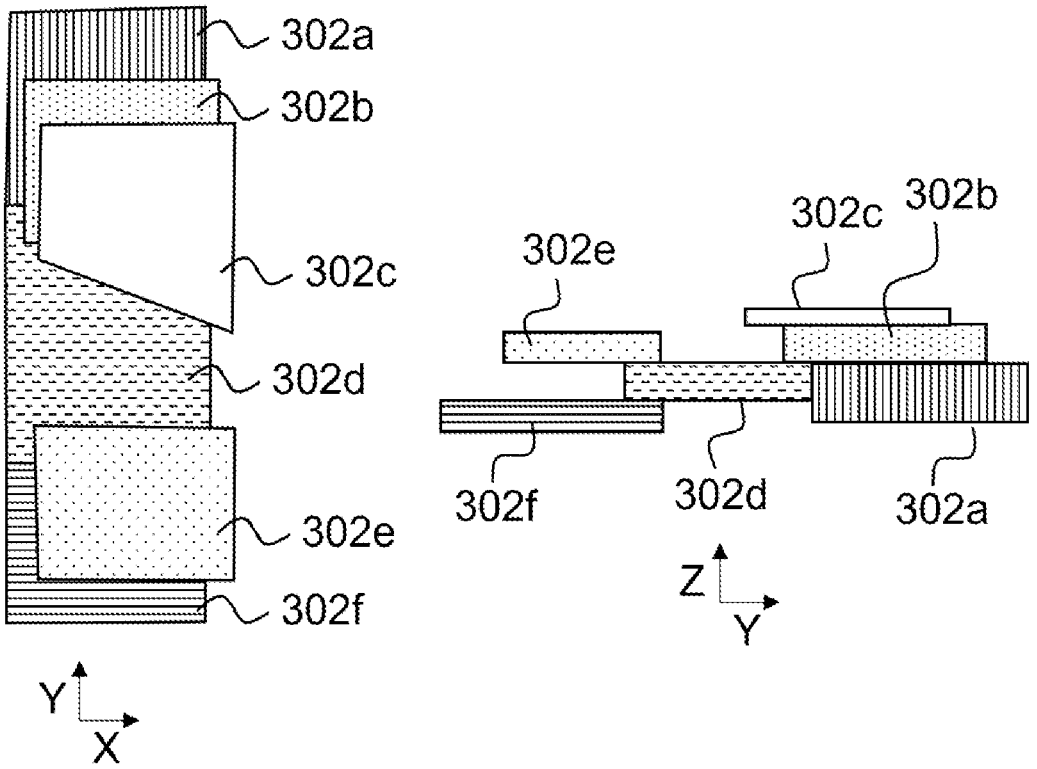

[Fig. 4]
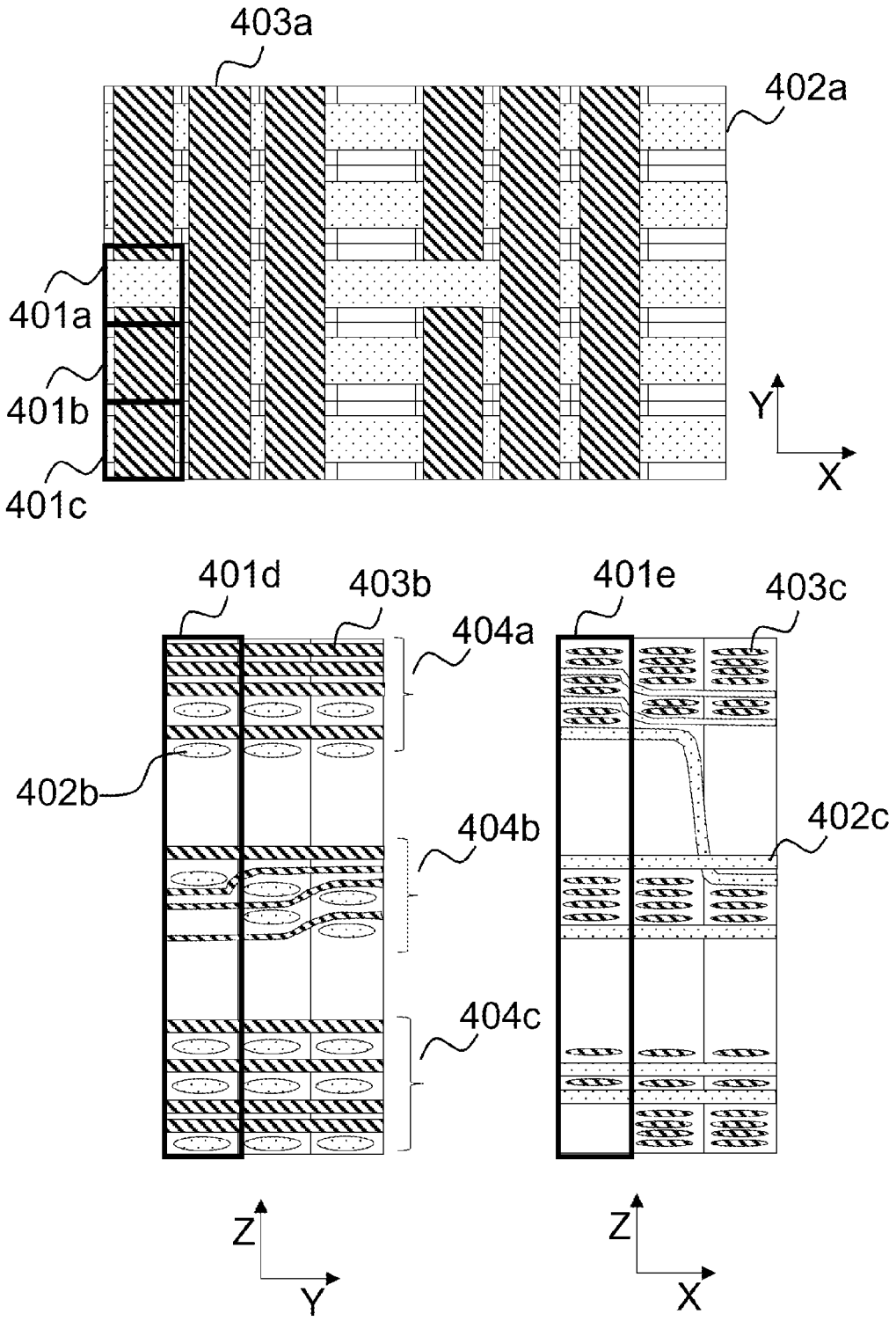

[Fig. 5]
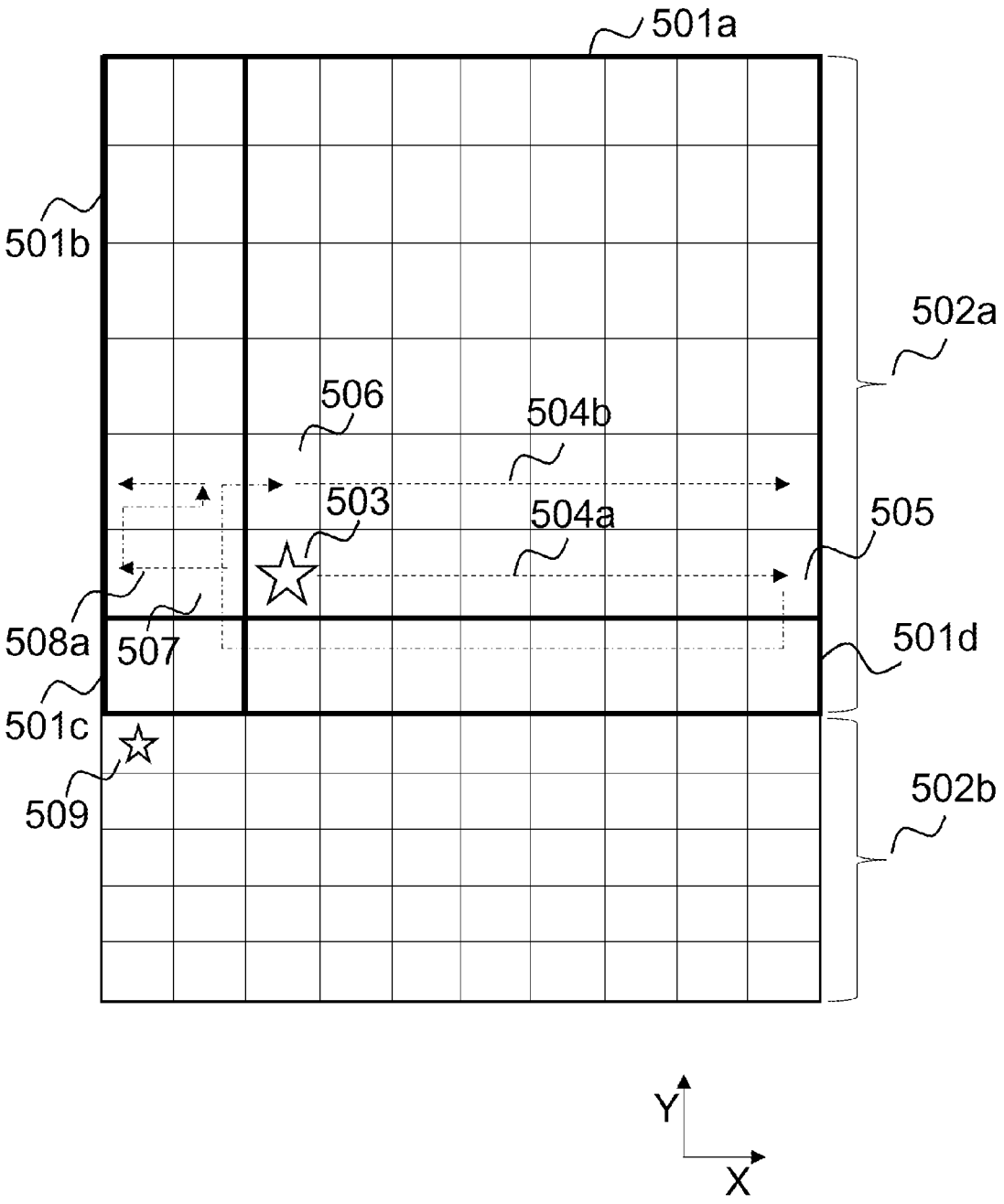

[Fig. 6]
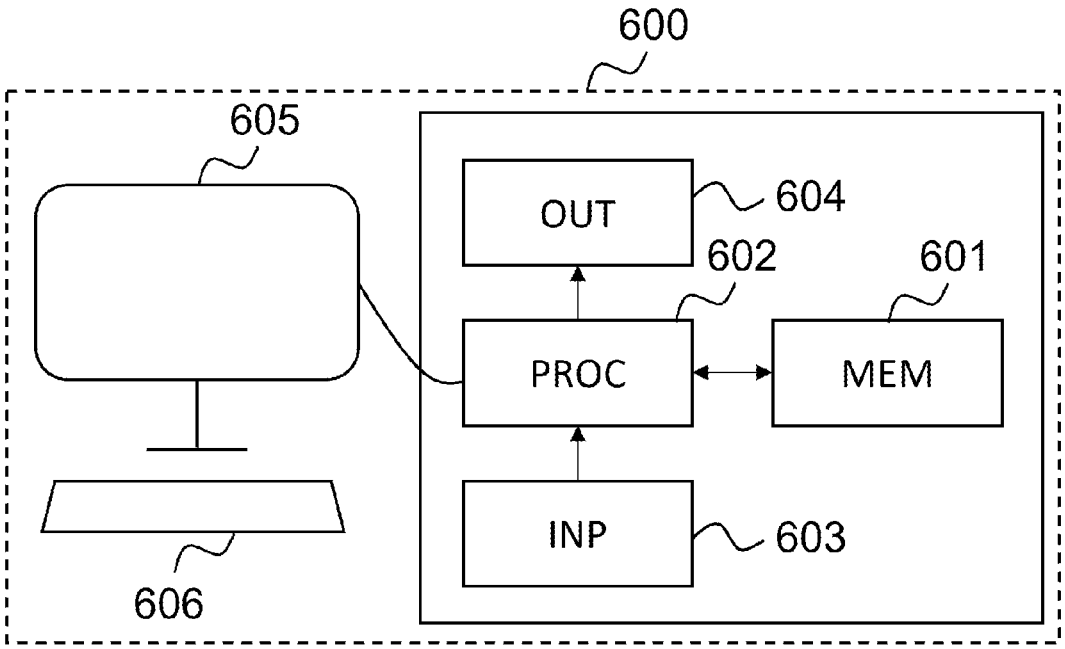

[Fig. 7]
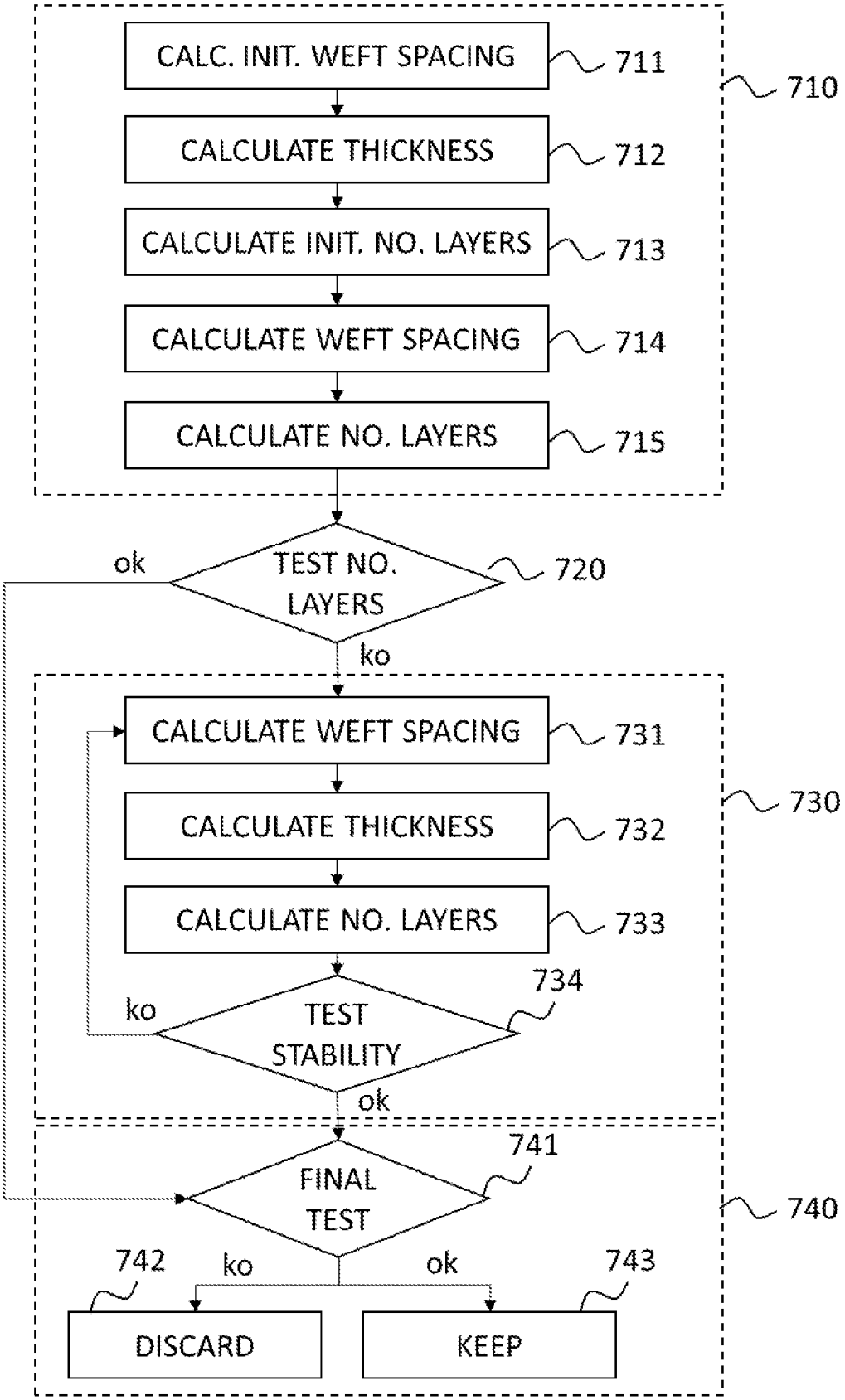

METHOD FOR DETERMINING A WEAVING MAP

CROSS-REFERENCE TO RELATED APPLICATIONS

This application is the U.S. National Stage of PCT/FR2023/051839, filed Nov. 22, 2023, which in turn claims priority to French patent application number 2212588, filed Nov. 30, 2022. The content of these applications are incorporated herein by reference in their entirety.

TECHNICAL FIELD OF THE INVENTION

The technical field of the invention is that of parts made in a woven composite material, especially aeronautical parts such as aircraft engine fan blades.

In particular, the invention relates to the design of a woven reinforcement for a part by making a weaving map representing the weaving structure of the reinforcement before it is manufactured.

Technological Background of the Invention

A woven composite material is an assembly including at least one woven textile framework referred to as reinforcement and a binder referred to as matrix. The reinforcement comprises strands (also referred to as "yarns") woven using a weaving machine, according to a theoretical weaving topology defined along at least two orientations, also referred to as reinforcement axes, each strand comprising a plurality of fibres, often carbon or glass fibres. The reinforcement axes are conventionally referred to as "warp" and "weft". In general, the warp corresponds to the main weaving direction, and the weft corresponds to the transverse direction, orthogonal to the warp. The way in which the strands are interlaced (i.e. the pattern according to which the strands are woven) is conventionally referred to as "weave".

An example of such a woven composite material is represented in FIG. 1. In FIG. 1, the reinforcement of the woven composite material 100 comprises strands 101, 102 woven according to a defined weaving topology over several layers 103*a*, 103*b*, the strands being arranged along two orthogonal reinforcement axes X and Y, referred to as warp and weft respectively, the layers 103*a*, 103*b* being superimposed along the axis Z.

Manufacturing a part in a woven composite material therefore requires a first step of manufacturing (or "tailoring") the reinforcement by weaving, and then a second step of assembling it with the matrix, for example by injection after shaping in a mould. At the end of the first step of manufacturing the reinforcement by weaving, a woven reinforcement is obtained, also referred to as a "preform".

For example, in the resin transfer moulding method, the preform is placed in a rigid mould, with the preform embracing shape of the mould. A liquid or viscous resin is then injected into the mould containing the preform using a low-pressure pump.

The design of the woven reinforcement, i.e. the preform, is a complex process, requiring in-depth knowledge of the material properties derived from the structure and type of reinforcement, as well as the manufacturing methods. Indeed, the composite material should have some mechanical characteristics, which are set by the engineering and design department as a function of the type of part, while its manufacturing method is subject to various constraintconstraints.

Thus, the design of woven reinforcement requires a great deal of upstream work, during which an optimum compromise must be found between requirements relating to the material characteristics and constraints imposed by the weaving. Software incorporating textile layer optimisation algorithms is available, but this software does not take account of constraints imposed by the weaving or the optimisation of the weaves. As a result, programming a textile part takes a great deal of time (in the order of several months for a complex part), which has a major impact on the iterations between the engineering and design department and the fabric shop and, consequently, on product development times.

The invention improves the situation.

SUMMARY OF THE INVENTION

The invention offers a solution to the problems previously discussed, by enabling the architecture of the woven reinforcement to be designed automatically and quickly according to one set of manufacturing constraints.

One aspect of the invention thus relates to a computer-implemented method for determining a weaving map of a zone of a part to be manufactured in a woven composite material. The method may comprise:

- receiving a representation of said zone of the part;
- receiving predefined values of parameters relating to manufacturing constraints of the zone of the part;
- determining, from the representation of the zone of the part and a first subset of values among the predefined values received, a weaving grid of the zone of the part, the weaving grid comprising a plurality of cells; and
- successively determining, for each cell of the weaving grid, a respective weaving composition compatible with a second subset of values among the predefined values received;

wherein the determining of a weaving composition for a current cell of the weaving grid depends on a weaving composition already determined for a cell of the weaving grid adjacent to the current cell; and wherein the weaving map of the zone of the part comprises the cells of the weaving grid and the respective weaving compositions.

By "weaving map", it is meant a set of data for representing weaving associated with a zone on a mechanical part (for example a woven reinforcement). By "weaving composition», it is meant a set of data for characterising weaving in the zone concerned, especially the type of yarns used and the way in which the yarns are disposed relative to each other. In other words, the weaving composition allows weaving within a cell to be completely defined, and the weaving map corresponds to all the weaving compositions for the cells. In this way, the weaving map can represent the weave architecture of the zone of the mechanical part.

By "zone", it is meant a region of a mechanical part to be manufactured in a woven material. A mechanical part to be manufactured may comprise a plurality of zones. By extension, the term "zone" can also designate an entire mechanical part (for example of small size, and for which the manufacturing constraints are the same at every point of the part).

The parameters relating to the manufacturing constraints of the zone are parameters representing criteria to be met for the weaving design, which are typically determined or validated upstream by experts. The values of these parameters depend on the type of part to be manufactured, and even on the zone of the part to be manufactured. In other words, for two different zones of a same part (for example the root and tip of an engine fan blade), the parameter values may differ.

By "weaving grid", it is meant a mesh of the zone of the part in question. Determining the weaving grid therefore involves determining this mesh, and especially the dimensions of the cells. This determination is advantageously carried out on the basis of a first subset of values from among the predefined values of the parameters relating to the manufacturing constraints received.

By "weaving composition", it is meant a set of parameters enabling the weave to be characterised (number of warp and weft yarns, relative arrangement of the yarns with respect to each other, number of layers, etc.). For each cell in the weaving grid, the weaving composition is determined by virtue of a second subset of values from among the predefined values of the parameters relating to the manufacturing constraints received. Thus, the composition determined advantageously takes account of the manufacturing constraints imposed on the part.

By "current cell", it is meant a cell for which the weaving composition has been determined (i.e. the cell considered at a current step in the method), as opposed to cells for which the compositions have already been determined and cells for which the weaving composition is determined at steps subsequent to the current step. By "adjacent cell" (or neighbouring cell), it is meant a cell belonging to a predefined neighbourhood of the cell in the weaving grid, for example a 4-connexity neighbourhood.

The above method provides for determining, in successive steps, a respective weaving composition for each cell in the weaving grid. In other words, once the weaving composition has been determined for one cell, the weaving composition is determined for another cell, and so on until all the cells in the gate have been covered. By "weaving composition already determined for a cell", it is therefore meant a weaving composition determined for a cell different from the current cell during a step prior to the current step.

According to this method, the weaving composition of a cell advantageously takes account of the weaving compositions already determined for neighbouring cells, thus avoiding structural problems in the weaving composition (for example, weaving compositions that are not compatible between adjacent cells).

In one or more embodiments, representing the zone of the part may comprise at least one two-dimensional modelling of the zone of the part. For example, the at least one two-dimensional modelling of the part may comprise at least one thickness map of the zone of the part.

By "thickness map of the zone of the part", it is meant a set of data making it possible to characterise a contour of a cross-section of the part in a plane (X,Y), for example, and thicknesses along the axis Z within this contour. For example, thickness mapping can take the form of an image making the contour appear, wherein each pixel within the contour is associated with a value which depends on the thickness of the part at that pixel.

In one or more embodiments, the method further comprises: receiving an initial cell from the plurality of cells of the weaving grid; wherein successively determining, for each cell of the weaving grid, the respective weaving composition is carried out according to an order of travelling the cells of the weaving grid a starting point of which corresponds to the initial cell, the order of travelling the cells being such that each current cell other than the initial cell for which the weaving composition is determined is adjacent to another cell of the weaving grid for which the weaving composition has already been determined.

In other words, by virtue of such an order of travelling, it is ensured that the weaving compositions of the cells are determined from the weaving compositions already determined for neighbouring cells.

In one or more embodiments, determining the weaving composition for the current cell in the weaving grid depends on all the weaving compositions already determined for the cells in the weaving grid adjacent to the current cell.

In one or more embodiments, the first subset of the predefined values received may comprise a list of permissible weaves, a list of permissible weft yarn counts, a list of permissible warp yarn counts and one or more target warp spacing values. Determining the weaving grid for the zone of the part may include:

- selecting weave for the zone from the list of permissible weaves;
- selecting a weft yarn count for the zone from the list of permissible weft yarn counts;
- selecting a warp yarn count for the zone from the list of permissible warp yarn counts;
- determining a warp spacing value from the one or more target warp spacing values and the warp yarn count selected; and
- determining a weft spacing for the zone as a function of the warp yarn count selected, the weft yarn count selected and the warp spacing target value determined.

In one or more embodiments, the respective weaving composition may comprise a set of parameters representative of a number of weft yarns and warp yarns and a relative arrangement of the weft yarns and warp yarns in said each cell of the weaving grid.

For example, for each cell of the weaving grid, determining the respective weaving composition may comprise: associating a respective vector with said each cell, and assigning to each component of the vector a value indicating a presence or absence of a yarn at a position corresponding to said component in the cell, and an associated yarn type. The yarn type may be one of: a warp yarn and a weft yarn.

In one or more embodiments, the representation of said zone of the part received may comprise thickness data representing thicknesses of the zone of the part at a plurality of points of the zone of the part, and determining the weaving composition for a current cell of the weaving grid may comprise: determining a number of weaving layers in the current cell as a function of a thickness piece of data representing a thickness at a point of the zone of the part corresponding to the current cell and as a function of at least one number of weaving layers already determined for at least one respective cell of the weaving grid adjacent to the current cell.

Thus, the number of layers in a cell is advantageously determined by taking account of the number of layers in neighbouring cells for which the weaving composition has already been determined.

In one or more embodiments, the second subset of parameters relating to manufacturing constraints of the zone of the part may comprise a target fibre volume fraction value and a target warp-weft ratio value. The weaving composition of a cell of the weaving grid may be determined so as to jointly minimise a difference between a fibre volume fraction value in the cell and the target fibre volume fraction value and a difference between a warp-weft ratio value in the cell and the target warp-weft ratio value.

Alternatively, the second subset of parameters relating to manufacturing constraints of the zone of the part may comprise a range of target fibre volume fraction values and a range of target warp-weft ratio values. The weaving composition of a cell of the weaving grid may be determined such that a fibre volume fraction value in the cell falls within the range of target fibre volume fraction values and a warp-weft ratio value in the cell falls within the range of target warp-weft ratio values.

A combination of these embodiments is of course possible (minimising the difference between the value obtained and the target value for one of the parameters, and determining the value so that it falls within the range of target values for the other parameter).

Another aspect of the invention relates to a computer-implemented method for determining a weaving map of a part to be manufactured in a woven composite material. The method may comprise:

receiving a plurality of zones of the part to be manufactured, wherein each zone comprises at least one portion adjacent to a portion of another zone;

for each zone of the plurality of zones, successively determining weaving maps of said each zone by the above method;

wherein the determining of the weaving map of a current zone is as a function of the weaving map of a zone other than the current zone for which the respective weaving map has been determined, the current zone comprising a portion adjacent to a portion of the other zone.

In these embodiments, determining the weaving map for the current zone may comprise:

identifying a cell in the current zone adjacent to at least one cell in the other zone for which the respective weaving map has been determined; and determining the weaving composition for the cell identified from the at least one weaving composition determined for the at least one adjacent cell of the respective other zone.

Thus, adjacent zones for which weaving maps have already been determined are advantageously taken into account when determining the weaving map of a current zone.

The plurality of zones can comprise groups of zones, each group of zones being respectively associated with a level (or layer) of the part to be manufactured.

In one or more embodiments, the part to be manufactured may be an aeronautical part.

Another aspect of the invention relates to a method for manufacturing a part in a woven composite material which may comprise:

determining a weaving map for the part according to one of the above methods;

manufacturing the part from the weaving map of the part determined.

Another aspect of the invention relates to a device for determining a weaving map of a zone of a part to be manufactured in a woven composite material.

The device may comprise:

an input interface for receiving a representation of said zone of the part and predefined values of parameters relating to manufacturing constraints of the zone of the part;

at least one circuit for:

determining, from the representation of the zone of the part and a first subset of values from the predefined values received, a weaving grid of the zone of the part, the weaving grid comprising a plurality of cells; and successively determining, for each cell of the weaving grid, a respective weaving composition compatible with a second subset of values from among the predefined values received;

wherein determining the weaving composition for a current cell of the weaving grid depends on a weaving composition already determined for a cell of the weaving grid adjacent to the current cell; and wherein the weaving map of the zone of the part comprises the cells of the weaving grid and the respective weaving compositions.

Another aspect of the invention relates to a system for determining a weaving map of a part to be manufactured in a woven composite material, the part to be manufactured comprising a plurality of zones, wherein each zone comprises at least one portion adjacent to a portion of another zone, the system comprising a plurality of preceding devices, each device being configured to determine a weaving map of a respective one of the plurality of zones; wherein determining the weaving map of a current zone is as a function of the weaving map of a zone other than the current zone for which the respective weaving map has been determined, the current zone comprising a portion adjacent to a portion of the other zone.

The invention also relates to a system for manufacturing a part in a woven composite material, which may comprise:

a system for determining a weaving map of the part to be manufactured as previously; and a weaving machine for producing the part from the weaving map of the part determined.

A computer program, implementing all or part of the method described hereinbefore, installed on pre-existing equipment, is in itself advantageous.

Thus, the present invention is also directed to a computer program product including instructions for the implementation of some steps of the methods previously described, when this program is executed by a processor.

This program can use any programming language (for example, an object language or other), and be in the form of interpretable source code, partially compiled code or fully compiled code.

FIG. 2, described in detail hereinafter, can form the flowchart of the general algorithm of such a computer program.

The invention and its different applications will be better understood upon reading the following description and upon examining the accompanying figures.

BRIEF DESCRIPTION OF THE FIGURES

Further characteristics and advantages of the invention will become apparent upon reading the description, which can be read in connection with the figures. These figures are set forth by way of indicating and in no way limiting purposes of the invention.

FIG. 1 represents an example of a woven composite material.

FIG. 2 represents a flow chart of a method for determining a weaving map for a part to be manufactured in a woven composite material, according to one embodiment.

FIG. 3*a* represents an example of regions of a part to be manufactured in a woven composite material.

FIG. 3*b* represents an example of levels (or layers) of a part to be manufactured in a woven composite material.

FIG. 4 represents several cross-sections of a weaving grid of a portion of a part to be manufactured in a woven composite material, according to one embodiment.

FIG. 5 represents an order of travelling the weaving grid, according to one embodiment.

FIG. 6 represents a device configured to implement steps of the method for determining a weaving map for a part to be manufactured in a woven composite material, according to one embodiment.

FIG. 7 represents an example of a method for determining the weaving composition of an initial cell according to one embodiment.

DETAILED DESCRIPTION

FIG. 2 represents a flow chart of a method for determining a weaving map for a part to be made from a woven composite material, according to one or more embodiments.

By "weaving map", it is meant a spatial representation of the structure (i.e. the different types of yarns used and the way in which they are intertwined) of the reinforcement of the part to be manufactured, which map can then be used to weave said reinforcement according to the structure determined. By extension, the term "weaving map" also designates a set of data characterising or making it possible to obtain the spatial representation of the structure of the woven reinforcement.

In a first step 210, a model of the part to be manufactured can be received. The model of the part to be manufactured may especially include a 2D representation of the part, as well as different zones of the part. The 2D representation can be, for example, a 2D thickness map, i.e. a 2D model representing a contour of the part (typically the contour of a 2D projection of the part onto a plane (X,Y)) and, for each point inside the contour, a thickness piece of data for the thickness of the part at this point along a third direction (for example Z). The model received in step 210 may further include data relating to different zones of the part, the different zones of the part corresponding to regions of the part whose properties or weaving constraints differ between them.

One example of such regions is represented in FIG. 3*a*. In the example of FIG. 3*a*, the part to be manufactured is an aircraft engine fan blade, and four zones 301*a*, 301*b*, 301*c*, 301*d* of the part are predefined. In this example, the zones 301*a*, 301*b*, 301*c*, 301*d* correspond to four regions subdividing the fan blade along its longitudinal axis. Of course, according to the embodiments, the number of zones may be different from four (for example one, two, three, five or more than five), and the zones may be defined along other axes, or even along no favoured axis (the zones constituting any mapping of the part). In the example of FIG. 3*a*, the zones 301*a*, 301*b*, 301*c*, 301*d* represent regions of the part for which the desired mechanical properties and weaving constraints are not necessarily the same from one region to another. On the other hand, the desired mechanical properties and weaving constraints do not vary within a predefined zone.

Furthermore, in one or more embodiments, the model of the part to be manufactured received during step 210 of FIG. 2 may comprise a plurality of "levels" (or layers), i.e. a set of strata, some of which are superimposed (partially or totally), generally defined by an expert and for use in computer-aided design software. An example of levels is represented in FIG. 3*b*.

In the example of FIG. 3*b*, the object model comprises a plurality of levels 302*a*, 302*b*, 302*c*, 302*d*, 302*e*, 302*f*, represented on the left-hand scheme in a frame of reference (X,Y) and on the right-hand scheme in a frame of reference (Y,Z). Each level can itself be comprised of one or more zones as previously defined with reference to FIG. 3*a*. Thus, in some embodiments, the model of the part received in step 210 of FIG. 2 may comprise a plurality of 2D representations respectively associated with the different levels and the different zones. For example, a 2D thickness map can be received for each layer, the thickness map making the geometry (i.e. the contours) appear, as well as data to characterise the different zones of the levels. Of course, the number of levels is not set to six, as in the example in FIG. 3*b*. According to the embodiments, there may be a single level, or any (integer) number of levels, or even no level as such (the part is then represented by a 2D model comprising one or more zones).

Referring again to FIG. 2, in one or more embodiments, the coordinates of a reference point, also referred to as "zero part", can be received during step 210. Advantageously, this reference point belongs to a single zone as defined previously, and to a single level if the model comprises a plurality of levels. As detailed later, this reference point constitutes the starting point for determining the weaving composition in the different cells of the model (also referred to as "populating" the cells). The coordinates of the zero part are conventionally set to (0,0,0) in the three-dimensional orthogonal reference frame (X,Y,Z).

In a step 220, a set of predefined parameter values relating to manufacturing constraints is received. These are predetermined values, which correspond to target values (i.e. values that are desired to be reached by means of the method) or imposed values (for example by the weaving machine or by constraints related to the part to be manufactured and known to experts in the field). These predetermined values are conventionally set by an expert as well as by the technical specifications, but also by the constraints of the weaving machine, for example. Parameters relating to manufacturing constraints may be related to desired mechanical characteristics for the part (necessary for the part to be certified and used subsequently), and may therefore relate to the yarns used and/or the way in which the yarns are arranged, such as the warp-weft ratio or the fibre volume fraction. It is remembered that the warp-weft ratio (WWR) corresponds to the ratio between the mass per unit area of the warp yarn and the mass per unit area of the weft yarn, and that the fibre volume fraction (VF) corresponds to the percentage of fibres in a volume of the composite material (reinforcement and matrix).

The predefined values can be associated with a specific zone of the model received in step 210. Thus, in step 220, several sets of values can be received, each set being associated with a respective zone.

For example, taking the example of FIG. 3*a*, sets of respective WWR and VF values may be received at step 220 for zones 301*a* (fan blade root), 301*b* (lower median part), 301*c* (upper median part) and 301*d* (fan blade tip). For each zone 301*a*, 301*b*, 301*c*, 301*d*, the WWR and/or VF value may be one or more point values, or an interval of values.

The parameters relating to manufacturing constraints can also be directly linked to the weaving method employed. Indeed, the weaving of some reinforcements may be subject to limitations in terms of weaving, either because of the part itself (because, for example, of its geometry and its future use—for example, a fan blade and an engine retention casing are not made according to the same weaving method), or because of the weaving machine used (which may not, for example, allow all the weaves or all the types of yarn to be used). Thus, the predefined values of the parameters received at step 220 may also include, in a non-limited manner, one or more values from among: one or more permissible weaves, a target weft spacing value (or range of values), a target warp spacing value (or range of values), one or more possible weft yarn counts, one or more possible warp yarn counts, a maximum number of textile layers, a minimum number of textile layers, a minimum number of warps and a minimum number of wefts, a maximum number of warps and a maximum number of wefts.

It is remembered that the weave corresponds to the assembly pattern of the yarns (warp and weft interlacing pattern). The weft (resp. warp) spacing corresponds to the distance between two successive weft (resp. warp) yarns. The yarn "count" corresponds to the type of yarn, characterised by its linear mass, which especially depends on the number of fibres of which it is comprised. For example, the yarn counts available may be 12 k, 24 k, 36 k, 48 k, 72 k, etc., where an "Xk" count corresponds to a yarn comprising X×1000 fibres per yarn. The list of available yarn counts may differ between warp and weft. The maximum (resp. minimum) number of textile layers corresponds to the maximum (resp. minimum) number of textile layers that a warp yarn can (resp. must) pass through in the thickness direction—this technique is used in 3D weaving, allowing interlacing between the different layers, thereby eliminating interfaces within the reinforcement and consequently improving its mechanical properties. Finally, the maximum (resp. minimum) number of warps (resp. wefts) represents the maximum (resp. minimum) number of warp (resp. weft) yarns in a warp/weft plane (X,Y).

A weaving grid is then determined in a step 230. In one or more embodiments, the weaving grid may comprise a plurality of grids, referred to herein as 2D "intermediate weaving grids", each intermediate weaving grid being, for example, respectively associated with one of the plurality of levels received, if necessary, in step 210 and/or with one of the plurality of zones received, if necessary, in step 210. When the model comprises only one level (or no levels) and only one zone, there may be only one intermediate gate, which constitutes the weaving grid.

Each intermediate weaving grid may comprise a plurality of cells, for example $n_X \times n_Y$ cells distributed along the warp and weft axes (X,Y). Each cell of an intermediate weaving grid may be associated with a thickness value, which represents a thickness of the cell in a third direction Z. The thickness values of the cells are variables, which form part of the parameter values that the method described suggests determining.

In step 230, intermediate weaving grids are determined for all levels and/or zones of the part, based on the representation received in step 210 and predefined values of parameters relating to manufacturing constraints received in step 220. For a zone of a level, for example, the associated weaving grid can represent a mesh of said zone of the level, wherein each cell of the mesh can be associated with a cell thickness value, as well as with a number of textile layers in the cell.

According to one embodiment, step 230 may comprise a first step of determining the weaving composition associated with a so-called "initial" cell, which corresponds to the zero part. Thus, when the model received in step 210 comprises several zones/levels, determining 230 the intermediate weaving grids respectively associated with these zones/levels begins with determining the intermediate weaving grid associated with the zone/level comprising the zero part, and with a first step of determining the weaving composition of the cell associated with the zero part. Once the intermediate weaving grid associated with the level/zone comprising the zero part is determined, the other intermediate weaving grids can in turn be determined according to an order explained below.

In this first step of determining the weaving composition of the initial cell, one or more combinations of values for the following parameters are determined: weave, weft and warp yarn counts, warp spacing and weft spacing. A number of layers for the initial cell is also determined. These combinations of values are determined so as to be compatible with the weaving constraints, i.e. with the values of the parameters relating to manufacturing constraints received in step 220.

There may be several combinations of weaving parameter values compatible with the values of the parameters relating to manufacturing constraints received at step 220. In this case, the user may have to select one or more of the compatible combinations to continue with the method of FIG. 2.

In one or more embodiments, this first step of determining the weaving composition of the initial cell may also comprise determining a number of layers in the initial cell (i.e. corresponding to the zero part) and determining a thickness of the initial cell. For example, the thickness of the initial cell may be determined from a weft spacing of possible weft spacing values and the thickness of the part, provided as input with the model of the part in step 210 (typically the value indicated by the thickness map at the point corresponding to zero part). The number of layers can be determined from a warp yarn count from the list of possible warp yarn counts, a weft yarn count from the list of possible weft yarn counts, a cell thickness and a target fibre volume fraction.

One example of the implementation of this first step of determining the weaving composition of the initial cell according to one mode of implementation is represented in FIG. 7.

The inputs to this first determination step are: the list of possible warp yarn counts, the list of possible weft yarn counts, a warp spacing, a target volume fraction, a target warp-weft ratio, a minimum number of layers and a maximum number of layers for the cell, and a minimum weft spacing and a maximum weft spacing for the cell.

In a first series of steps 710, a weft spacing and a number of layers in the initial cell are determined, for each possible {warp yarn; weft yarn} combination from the list of possible warp yarn counts and the list of possible weft yarn counts. For example, if the list of possible warp yarn counts comprises 3 yarn counts and the list of possible weft yarn counts comprises 2 yarn counts, the weft spacing and the number of layers are determined for the 3×2=6 possible combinations. The series of steps 710, as well as the series of steps 720 and the final test 730, are therefore implemented for the 6 possible combinations.

For each {warp yarn; weft yarn} combination from the set of possible combinations, an initial weft spacing is calculated in a step 711. This initial weft spacing can be calculated as a function of the warp spacing and the target warp-weft ratio:

$$FLinit = f_{FL}(\text{warp spacing, target } WWR).$$

And then a thickness of the cell can be determined in step 712 as a function of the initial screen spacing calculated in step 711:

$$t = f_t(FLinit).$$

An initial number of layers can then be determined in a step 713, from the warp yarn count, weft yarn count, initial weft spacing (determined in step 711), target volume fraction (VF) and thickness (determined in step 712):

$$NBinit = f_{NB}(\text{warp yarn, weft yarn, } FLinit\text{, target } VF, t).$$

The weft spacing value can then be updated in step 714 from the warp yarn count, the weft yarn count, the initial number of layers determined in step 713, the target VF and the thickness determined in step 712:

$$FL = f_{FL}(\text{warp yarn, weft yarn, } NBinit\text{, target } VF, t).$$

Finally, the number of layers in the cell can be updated in a step 715, as a function of the warp yarn count, weft yarn count, weft spacing updated in step 714, target VF and thickness determined in step 712:

$$NB = f_{NB}(\text{warp yarn, weft yarn, } FL\text{, target } VF, t).$$

Once the weft spacing and number of layers in the initial cell have been determined in the series of steps 710 (comprising steps 711 to 715), a test can be performed in step 720 on the number of layers determined in step 715. If the number of layers obtained in step 715 is different from the initial number of layers determined in step 713, a new series of steps 720 may be implemented to optimise the number of layers and stabilise that number of layers as a function of variations in weft spacing and thickness. If the number of layers obtained in step 715 is equal to the initial number of layers determined in step 713, the series of steps 740 can be directly implemented.

When implemented, the series of steps 730 may include a step 731 of updating the weft spacing, a step 732 of updating the cell thickness, updating 733 the number of layers and testing 734 stability of the number of layers.

The weft spacing may be updated in step 731 as a function of the warp yarn count, the weft yarn count, the number of layers determined in step 715, the target VF and the cell thickness determined in step 712:

$$FL = f_{FL}(\text{warp yarn, weft yarn, } NB\text{, target } VF, t).$$

And then the thickness of the cell can be updated in step 732 as a function of the weft spacing calculated in step 731:

$$t = f_t(FLinit).$$

The number of layers can then be updated in step 733 as a function of the warp yarn count, weft yarn count, weft spacing updated in step 731, target VF and thickness updated in step 732:

$$NB = f_{NB}(\text{warp yarn, weft yarn, } FL\text{, target } VF, t).$$

Finally, a stability test 734 on the number of layers is implemented, wherein it is verified whether the number of layers updated at a step 733 is sufficiently close to the number of layers calculated at step 733 of the preceding iteration of the series of steps 730 (or to the number of layers calculated at step 715 if this is the first iteration of the series of steps 730). In other words, test 734 corresponds to a convergence test of the number of layers calculated. A convergence criterion may be, for example, a difference between the current value of the number of layers and the preceding value of the number of layers below a predetermined threshold, and/or a difference between the current value of the number of layers and the minimum number of layers below a predetermined value (in other words, with this same criterion, it is checked whether the minimum number of layers has been reached).

If the convergence criterion is not met (test 734, arrow "ko"), a new iteration of the series of steps 730 is implemented. If the convergence criterion is met (test 734, "ok" arrow), the series of steps 740 is implemented.

The series of steps 740 includes a final test 741 at the end of which it is determined whether the calculated set of values is retained as a possible solution (743) or whether it is excluded from the possible solutions (742).

During the test 741, two cumulative conditions can be verified:

Condition 1: the weft spacing obtained at the end of the series of steps 730 when implemented, or at the end of the series of steps 710 when the series of steps 730 is not implemented, has to be between the minimum weft spacing and the maximum weft spacing; and Condition 2: the number of layers obtained at the end of the series of steps 730 when it is implemented, or at the end of the series of steps 710 when the series of steps 730 is not implemented, has to be less than or equal to the maximum number of layers.

If at least one of the two conditions is not verified, the calculated set of values (i.e. the {warp yarn count, weft yarn count, weft spacing, number of layers}) combination is discarded (step 742). If both conditions are verified, the set of values is kept (step 743), i.e. constitutes a possible set of values for determining the weaving grid.

At the end of the method described in FIG. 7, there may be one or more possible combinations, and the user can select one or more combinations from these possible combinations.

Referring again to FIG. 2, in step 230, once the composition of the initial cell has been determined, all the intermediate weaving grids can be constructed, starting with the intermediate weaving grid comprising the initial cell, and then constructing the intermediate weaving grids of the different zones/levels step by step, as described hereafter. Determining the intermediate weaving grid comprises determining, for each level zone typically, a weft spacing value and a warp spacing value (which therefore define the dimensions of the cells along the axes (X,Y)). For example, the warp and weft spacing values of the intermediate weaving grid associated with the level zone comprising the zero part may be equal to the warp and weft spacing values determined for the initial cell (corresponding to the zero part). For the other zones, the intermediate weaving grids can be constructed as a function of the possible warp/weft spacing values (received in step 220) for those zones.

Thus, step 230 may comprise, for each level zone or each level, determining a respectively associated intermediate weaving grid, this determining comprising determining a weave from the list of permissible weaves, a warp yarn count from the list of possible warp yarn counts, a weft yarn count from the list of possible weft yarn counts and a weft spacing compatible with the determined warp yarn count, the determined weft yarn count and the predefined warp spacing target value(s).

In one or more embodiments, where the pattern received in step 210 comprises a plurality of zones (belonging to one or more levels), step 230 comprises determining, for each zone of each level, a respective intermediate weaving grid, in a manner similar to that described previously. In these embodiments, the intermediate weaving grids are created successively for each zone, starting with the zone comprising the zero part. And then, each intermediate weaving grid corresponding to a new zone is determined as a function of the intermediate weaving grids already determined for the neighbouring zones. Indeed, in these embodiments, the transitions between zones have also to be taken into consideration, to avoid incompatibilities between two adjacent weaving grids, for example in terms of weft or warp spacing, or weft and/or warp yarn counts selected. To ensure a "smooth" transition between two neighbouring intermediate weaving grids (i.e. associated with zones having adjacent portions, said zones possibly belonging to the same level or to two different levels), transition grids can be determined. For example, for two neighbouring intermediate weaving grids, it is possible to modify the two intermediate weaving grids locally (around adjacent portions) to ensure continuity of order C1 between them.

By "neighbouring weaving grid", it is meant a weaving grid of which at least some cells are adjacent to the cells of the other weaving grid.

In these embodiments, it is possible to define an order for processing levels and zones, to ensure that a weaving grid is actually determined as a function of neighbouring weaving grids. For example, for each level, it is possible to rank the zones on that level according to the distance from their centre to the zero part. It is also possible to classify the levels according to their "order of vicinity" to the level containing the zero part: for example, the level containing the zero part can be associated with an order 0, levels having at least one region adjacent to the layer containing the zero part can be associated with an order 1, levels having no neighbouring regions to the zero part but having at least one neighbouring region to a layer of order 1 can be associated with an order 2, and so on.

In the example of FIG. 3*b*, if it is assumed that level 302*d* comprises the zero part, level 302*d* is assigned order 0, levels 302*a*, 302*b*, 302*e*, 302*f* are assigned order 1, and level 302*c* is assigned order 2.

The weaving grids can then be determined as follows: first, a level is selected in ascending order of levels, starting with 0 (two levels of the same order can be processed independently, successively or in parallel), and then, for each level, the weaving grids for the different zones are constructed successively, starting with the zone closest to zero part and then considering the zones in ascending order of distance from zero part.

Of course, other orders of determination are possible, as long as they take account of the vicinity to the zones and levels to each other.

Furthermore, when the object comprises several zones, the permissible weaves may be different according to the zones, and the weaves determined may therefore also be different according to the zones. In this case, step 230 may also comprise receiving so-called "transition" weaves, which correspond to weaves determined for the transition zones (i.e. zones comprising cells from a first zone and cells from a second neighbouring zone to the first zone). These transition weaves can advantageously be provided by the user, when the weaves of the two neighbouring zones are not compatible (for example when the minimum number of layers associated with one of the weaves is greater than the maximum number of layers associated with the other weave). In these embodiments, the method can include a step of detecting an incompatibility between two weaves of two neighbouring zones, and for issuing an alert indicating this incompatibility to the user, who can then provide, via a man-machine interface, a list of transition weaves for the region concerned.

In embodiments where the model received in step 210 comprises several zones, the method in FIG. 2 may comprise a step 240 in which an initial zone is selected to start the populating method. For example, this initial zone may correspond to the zone comprising the zero part received in step 210 (which belongs to only one zone). When the model received in step 210 comprises only one zone, step 240 can be omitted.

During a first iteration of step 250, an initial cell is determined. This initial cell is the starting point for the populating method. In other words, the initial cell is the first cell for which the weaving composition is determined. For example, the initial cell determined in step 250 for the initial zone determined in step 240 (or for the single zone of the model in the case wherein it comprises only one zone) may be the cell of the weaving grid associated with the zero part, i.e. the cell in which the zero part is located.

By "weaving composition", it is meant a description of the weaving yarns (warp and weft) and how they are positioned relative to each other in the cell or, equivalently, a set of data for describing the weaving yarns and how they are positioned relative to each other in each cell of the weaving grid. In particular, the data relate to the number of layers associated with each cell, the number of weft yarns and warp yarns per layer, the spacing between the layers, the spacing between the weft and warp yarns, the number of weft (resp. warp) yarns between two consecutive warp (resp. weft) yarns, etc. These data can be represented in the form of a 3D map, as in FIG. 4, where some cross-sections of such a map are represented.

FIG. 4 thus represents a weaving grid and weaving compositions for cells of the weaving grid, in several cross-sections. The weaving grid represented in FIG. 4 comprises a plurality of cells 401*a*, 401*b*, 401*c*, 401*d* and 401*e*. In this figure, the direction X corresponds to that of the warp yarns 402*a*, 402*b*, 402*c* (represented with dotted lines) and the direction Y corresponds to that of the weft yarns 403*a*, 403*b*, 403*c* (represented with hatches).

When the current cell is the cell corresponding to the zero part, step 260 (which corresponds to a step of determining the weaving composition) can be omitted, as the weaving composition of the initial cell has already been determined in step 230. At step 270, it is checked whether all the cells in the zone in question have been populated (i.e. whether step 260 of determining the weaving composition of a cell has been implemented for all the cells in the current zone). If all the cells have not yet been populated (step 275, arrow "N"), a new cell is considered (step 275) and the step of determining the weaving composition (step 260) is implemented for this new cell. When all the cells have been populated (step 270, arrow "Y"), and in the case where the model received in step 210 comprises a plurality of zones, it is checked in step 280 whether all the zones in the model have been populated. If some zones of the model have not yet been populated (step 280, arrow "N"), a new zone is considered (step 285), a new initial cell is determined for the new zone considered (step 250), and determining the weaving composition for the cells of the new zone is implemented (steps 260, 270 and 275). When all the zones in the model have been populated (step 280, arrow "Y"), the populating method is complete. It is then possible, for example, to graphically represent the 3D map of the part (step 290). Alternatively or complementarily, step 290 may involve representing successive cross-sections of the 3D map in the form of "weaving cartons", the cartons being usable as input data for the weaving machine to manufacture the woven reinforcement of the part.

When the model contains only one zone, steps 280 and 285 can be omitted.

In step 275, determining the new cell is performed from a predefined travel of the weaving grid/intermediate weaving grid. One example of such a travel is represented in FIG. 5.

In the example of FIG. 5, two intermediate weaving grids 502*a* and 502*b* are represented, corresponding respectively to two neighbouring zones in the model. In this example, the intermediate weaving grid 502*a* is assumed to include the zero part 503. The zero part 503 divides the intermediate gate 502*a* into four quadrants 501*a*, 501*b*, 501*c* and 501*d*, the first quadrant 501*a* comprising the zero part 503. As mentioned above, zero part 503 is the first cell for which the weaving composition is determined. And then the cells are filled (or "populated") step by step according to one predefined travel. In the example of FIG. 5, this predefined travel starts at the zero part 503 and continues in a given direction (herein, according to the lines from left to right, i.e. along the direction X) 504*a* within the first quadrant 501*a*. When the last cell 505 of the line in the first quadrant 501*a* has been populated, the line directly above 504*b* is populated, starting with the cell 506 directly above zero part 503.

The other three quadrants 501*b*, 501*c*, 501*d* may be populated in a similar manner. For example, the second quadrant 501*b* can be populated by starting with the cell 507 directly adjacent to the zero part 503, and then populating the cells step by step in a direction 508*a* opposite to the direction 504*a* of the first quadrant 501*a*, and moving up the lines along the direction Y in a similar way to the first quadrant 501*a*.

The four quadrants 501*a*, 501*b*, 501*c*, 501*d* can be populated successively or in parallel, once zero part 503 has been populated.

When all four quadrants 501*a*, 501*b*, 501*c*, 501*d* have been populated, the loop of steps 260-270-275 in FIG. 2 is completed for the current zone, and the next zone is selected if necessary (step 285 in FIG. 2). The next zone can be selected as previously described for determining 230 the weaving grid.

Referring again to FIG. 5, once the first intermediate weaving grid 502*a* has been populated, it is assumed that the second intermediate weaving grid 502*b* is selected to be populated in turn. A new initial cell 509 has to be selected to begin populating the second intermediate weaving grid 502*b* (new step 250). For example, the new initial cell 509 may be any neighbouring cell to a cell in the first intermediate weaving grid 502*a* that has already been populated.

During implementation of an iteration of step 260, the weaving composition of the current cell is therefore determined. This determination is carried out on the basis of the weave of the current zone determined in step 230, as well as the weft and warp yarns of the current cell determined in step 230, so as to jointly determine the difference between the fibre volume fraction in the cell thus filled and the target fibre volume fraction and the difference between the WWR in the cell thus filled and the target WWR, while taking account of the neighbouring cells already filled. In particular, the number of layers in the current cell depends on the number of layers in the neighbouring cells already filled. For example, it may be imposed that the number of layers in the current cell is between:

- the minimum number of layers of neighbouring cells already filled, minus a first predetermined permissible variation; and
- the maximum number of layers of neighbouring cells already filled plus a second predetermined permissible variation.

Furthermore, if the predefined values of the parameters relating to manufacturing constraints received in step 220 include a maximum or minimum number of layers, this number can be taken into account to determine the number of layers of the current cell in step 260.

Furthermore, rules relative to the number of layers can be predefined, to determine when the number of layers of a cell has to be reduced or increased relative to the number of layers of the cell filled in the preceding step. These rules are generally defined by the textile department and form part of the parameters relating to manufacturing constraints received at step 220. They may especially relate to constraints concerning an alternation of yarns or constraints of continuity in the number of layers.

The number of layers in the current cell can also be determined from the weave selected in step 230 for the zone comprising the current cell (current zone). Indeed, according to the type of part to be manufactured, some weaving rules may be imposed, for example making a yarn division only when the weave applied to the zone belongs to a predefined group of weaves. If the weave applied to the zone does not belong to this weave group, it is not possible to divide the yarns, so the number of layers in the current cell has to be the same as in the neighbouring cells.

According to one example of implementation, each cell can be modelled by a data matrix, each component of this matrix representing information relating to the yarn present in the portion of the cell corresponding to the component of the matrix (each component can, for example, take one of the following values: a first value indicating that there is no yarn in the portion of the cell in question, a second value indicating that there is a weft yarn in the portion of the cell in question, and a third value indicating that there is a warp yarn in the portion of the cell in question). Of course, other implementations are possible. For example, two matrices of the same size can be associated with each cell, one corresponding to the warp yarns and the other to the weft yarns, and for each of the two matrices, the components can be equal to 0 if no yarn of the type concerned is present in the corresponding regions, and to a value representative of the yarn count used if a yarn of the type concerned is present in the corresponding regions. According to another implementation example, a 3D representation of the woven part can be represented by a 3D matrix containing cells, each cell representing a warp/weft intersect, wherein it is indicated whether or not the warp yarn is taken up by the weft yarn. This 3D matrix is constructed from the model of the part received in step 210 (for example the thickness maps), the weaving grids and the weaving compositions determined in steps 230 to 280.

The weaving compositions determined for cells in already populated zones that are neighbouring to cells in a new, not yet populated zone can be used as input data for populating this new zone. The same applies to the different levels of the model, if necessary.

The method of FIG. 2 can advantageously be applied in parallel for several possible weaving grids (as defined in step 230). Indeed, it may happen that, for a given weaving grid, the method cannot result in filling all the cells while complying with the manufacturing constraints. In this case, this weaving grid is discarded, and only the weaving grids for which all the cells in the model could be filled are retained. Furthermore, parallel application of the method for several weaving grids means that, at the end of the process, "overall" parameters can be determined for the weaving grids filled, for example an average number of layers, or an average volume fraction over all the cells of a weaving grid filled. It is then possible to select, from all the filled weaving grids, the one whose overall parameters are closest to the manufacturing constraints.

FIG. 6 represents a device for determining the values of shooting parameters for a projectile ingestion test on a fan blade in a static position, according to one or more embodiments of the invention.

In these embodiments, the device includes a computer 600, comprising a memory 601 for storing instructions for the implementation of the method, the predefined values of parameters relating to manufacturing constraints, and temporary data for performing different steps of the methods described previously.

The computer 600 further includes a circuit 602. This circuit may be, for example, a processor able to interpret instructions in the form of a computer program, an electronic board whose method of the invention steps are described in silicon, or even a programmable electronic chip such as an FPGA (Field-Programmable Gate Array) chip.

The computer 600 includes an input interface 403 for receiving the model of the part to be manufactured and predefined values of parameters relating to manufacturing constraints, and an output interface 604 for providing the weaving map. Finally, the computer may include a screen 605 and a keyboard 606 for easy interaction with a user. The keyboard is, of course, optional, especially within the scope of a computer in the form of a touch-sensitive tablet, for example.

Additionally, the block diagram set forth in FIG. 2 is a typical example of a program in which some instructions can be performed using the device described. As such, FIG. 2 may correspond to the flowchart of the general algorithm of a computer program for the purposes of the invention.

Of course, the present invention is not limited to the embodiments described hereinbefore by way of example; it extends to other alternatives.

The invention claimed is:

1. A computer-implemented method for determining a weaving map of a zone of a part to be manufactured in a woven composite material, comprising:

receiving a representation of said zone of the part;

receiving predefined values of parameters relating to manufacturing constraints of the zone of the part;

determining, from the representation of the zone of the part and a first subset of values among the predefined values received, a weaving grid of the zone of the part, the weaving grid comprising a plurality of cells; and successively determining, for each cell of the weaving grid, a respective weaving composition compatible with a second subset of values among the predefined values received;

wherein the determining of a weaving composition for a current cell of the weaving grid depends on a weaving composition already determined for a cell of the weaving grid adjacent to the current cell; and wherein the weaving map of the zone of the part comprises the cells of the weaving grid and the respective weaving compositions.

2. The method according to claim 1, wherein the first subset of values among the predefined values received comprises a list of permissible weaves, a list of permissible weft yarn counts, a list of permissible warp yarn counts and one or more target warp spacing values; wherein the determining of the weaving grid of the zone of the part comprises:

selecting a weave for the zone from the list of permissible weaves;

selecting a weft yarn count for the zone from the list of permissible weft yarn counts;

selecting a warp yarn count for the zone from the list of permissible warp yarn counts;

determining a warp spacing value from the one or more target warp spacing values and the warp yarn count selected; and determining a weft spacing for the zone as a function of the warp yarn count selected, the weft yarn count selected and the target warp spacing value determined.

3. The method according to claim 1, wherein, for each cell of the weaving grid, the respective weaving composition comprises a set of parameters representative of a number of weft yarns and warp yarns and a relative arrangement of the weft yarns and the warp yarns in said each cell of the weaving grid.

4. The method according to claim 1, wherein the representation of said zone of the part received comprises thickness data representing thicknesses of the zone of the part at a plurality of points of the zone of the part, wherein the determining of the weaving composition for a current cell of the weaving grid comprises: determining a number of weaving layers in the current cell as a function of a thickness piece of data representing a thickness at a point of the zone of the part corresponding to the current cell and as a function of at least one number of weaving layers already determined for at least one respective cell of the weaving grid adjacent to the current cell.

5. The method according to claim 1, wherein the second subset of parameters relating to manufacturing constraints of the zone of the part comprises a target fibre volume fraction value and a target warp-weft ratio value; wherein the weaving composition of a cell of the weaving grid is determined so as to jointly minimise a difference between a fibre volume fraction value in the cell and the target fibre volume fraction value and a difference between a warp-weft ratio value in the cell and the target warp-weft ratio value.

6. The method according to claim 1, wherein the part to be manufactured is an aeronautical part.

7. A computer-implemented method for determining a weaving map of a part to be manufactured in a woven composite material, comprising:

receiving a plurality of zones of the part to be manufactured, wherein each zone comprises at least one portion adjacent to a portion of another zone;

for each zone of the plurality of zones, successively determining weaving maps of said each zone by the method according to claim 1;

wherein the determining of the weaving map of a current zone is function of the weaving map of a zone other than the current zone for which the respective weaving map has been determined, the current zone comprising a portion adjacent to a portion of the other zone.

8. The method according to claim 7, wherein the determining of the weaving map of the current zone comprises:

identifying a cell of the current zone adjacent to at least one cell of the other zone for which the respective weaving map has been determined; and determining the weaving composition for the identified cell from the at least one weaving composition determined for the at least one adjacent cell of the respective other zone.

9. A method for manufacturing a part in a woven composite material comprising:

determining a weaving map for the part according to claim 7; and manufacturing the part from the weaving map of the part determined.

10. A non-transitory computer readable medium including instructions for implementing the method according to claim 1 when the instructions are executed by a processor.

11. A device for determining a weaving map of a zone of a part to be manufactured in a woven composite material, comprising:

an input interface for receiving a representation of said zone of the part and predefined values of parameters relating to manufacturing constraints of the zone of the part;

at least one circuit for:

determining, from the representation of the zone of the part and a first subset of values among the predefined values received, a weaving grid of the zone of the part, the weaving grid comprising a plurality of cells; and successively determining, for each cell of the weaving grid, a respective weaving composition compatible with a second subset of values among the predefined values received;

wherein the determining of the weaving composition for a current cell of the weaving grid depends on a weaving composition already determined for a cell of the weaving grid adjacent to the current cell; and wherein the weaving map of the zone of the part comprises the cells of the weaving grid and the respective weaving compositions.

12. A system for determining a weaving map of a part to be manufactured of woven composite material, the part to be manufactured comprising a plurality of zones, wherein each zone comprises at least one portion adjacent to a portion of another zone, the system comprising a plurality of devices according to claim 10, each device being configured to determine a weaving map of a respective one of the plurality of zones;

wherein determining the weaving map of a current zone is function of the weaving map of a zone other than the current zone for which the respective weaving map has been determined, the current zone comprising a portion adjacent to a portion of the other zone.

13. A system for manufacturing a part in a woven composite material comprising:

a system for determining a weaving map of the part according to claim 11; and a weaving machine for manufacturing the part from the weaving map of the part determined.

* * * * *